US005758530A

United States Patent [19]

Yoshikawa et al.

[11] Patent Number: 5,758,530

[45] Date of Patent: Jun. 2, 1998

[54] HOT ROLLING MILL

[75] Inventors: Masashi Yoshikawa; Keiji Mizuta; Ritsuo Hashimoto; Kazuo Morimoto; Hironori Fujioka; Jyun Sakamoto; Shinji Hirai; Jyunsou Fukumori; Shinsaku Kimura; Akira Kaya, all of Hiroshima, Japan

[73] Assignee: Mitsubishi Jukogyo Kabushiki Kaisha, Tokyo, Japan

[21] Appl. No.: 681,983

[22] Filed: Jul. 30, 1996

[30] Foreign Application Priority Data

Mar. 4, 1996 [JP] Japan ..... 8-045772
May 22, 1996 [JP] Japan ..... 8-127040

[51] Int. Cl.[6] ..... B21B 45/02; B21B 45/04; B21C 43/00

[52] U.S. Cl. ..... 72/40; 72/39; 134/64 R

[58] Field of Search ..... 72/38, 39, 40, 72/236; 260/111, 112, 113, 114; 29/81.06, 81.08, 81.09; 134/122 R, 64 R

[56] References Cited

U.S. PATENT DOCUMENTS

| | | | |
|---|---|---|---|
| 3,793,054 | 2/1974 | Franz | 134/64 R |
| 4,233,830 | 11/1980 | Houdion | 72/138 |
| 5,118,357 | 6/1992 | Sabatka | 134/122 R |
| 5,133,205 | 7/1992 | Rostik et al. | 72/200 |

*Primary Examiner*—Lowell A. Larson
*Assistant Examiner*—Rodney A. Butler
*Attorney, Agent, or Firm*—Wenderoth, Lind & Ponack

[57] ABSTRACT

A hot rolling line is constructed by a pair or a plurality of pairs of rolling rolls disposed opposingly on an upper side and on a lower side of a workpiece (1) to be rolled that is pinched in between the rollers. A descaling apparatus (5) has jet flow nozzles disposed so that two jetted flows, being liquid, gas or plasma, are opposing flows so as to collide with the surface of a strip on the upstream side of the rolling rolls and then collide with each other. The jet flow nozzles are disposed, so as to incline in a direction to face each other so that the angle of inclination is 15° to 60° from the horizontal direction of the strip surface.

18 Claims, 11 Drawing Sheets

HOT ROLLING MILL

BACKGROUND OF THE INVENTION

1. Field of the Invention:

The present invention relates to a hot rolling mill comprising a descaling apparatus.

2. Description of the Prior Art:

In FIG. 12, one example of a descaling apparatus (an apparatus to descale a metal plate surface) in a hot rolling mill in the prior art is shown. FIG. 12(*a*) is a perspective view of a main part and FIG. 12(*b*) is a side view of the same.

In FIG. 12, numeral 1' designates a metal plate workpiece to be rolled (strip), numeral 2' designates slit type jet flow nozzles and numeral 3' designates liquid jetted flows. In the descaling operation in a hot rolling line in the prior art, liquid jetted flows 3' are jetted in one direction to collide with a plane surface portion of the strip 1' from the slit type jet flow nozzles 2'. The nozzles 2' consist of a plurality of nozzles disposed so as to incline to the plane surface portion. Scales generated on the strip surface during the hot rolling work are descaled by the jetted flows 3'.

In the descaling apparatus in the prior art in which jetted flows are jetted in one direction to collide with the strip surface, as the jetted fluid, after collision, flows in the direction of the line along the surface of the workpiece to be rolled, its staying time on the surface is long. Thus there is the shortcoming in that the workpiece to be rolled is cooled more than is needed. If the temperature of the workpiece to be rolled is so lowered, the deformation resistance of the workpiece to be rolled increases, which causes a problem in the hot rolling work in the downstream processes.

Further, if the temperature of the workpiece to be rolled is lowered below the desirable temperature for rolling, the quality of the workpiece to be rolled might deteriorate, or there is a need to install a new heating apparatus.

SUMMARY OF THE INVENTION

It is therefore an object of the present invention to provide a hot rolling mill comprising a descaling apparatus which is able to resolve the above-mentioned shortcomings, shorten the staying time of the jetted fluid on the strip surface, and reduce the amount of lowering of the strip temperature.

To attain the above object, a hot rolling mill according to the present invention has a descaling apparatus provided immediately in front of a hot rolling machine line for rolling a metal workpiece. The descaling apparatus has first and second jet flow nozzles disposed so as to incline and to face toward both the downstream and the upstream directions so that two jetted flows, after colliding with the surface of the metal workpiece to be rolled, collide with each other.

The fluid jetted from the nozzles first collides with the surface of the workpiece, flows along the surface as it flakes scales on the surface, collides with the oppositely jetted fluid, and then flows in a direction away from the strip so that the scales are removed. Accordingly, the staying time of the jetted fluid on the strip surface is not as long as that in the apparatus of the prior art.

The descaling apparatus can be disposed between rolling machines in a hot rolling machine line, or between the first and the second rolling machines in a hot rolling machine line. The descaling apparatus can also be disposed immediately in front of a hot rolling machine line.

The jet nozzles are effectively disposed to be inclined in a direction facing each other and at an angle of 15° to 60° to the horizontal surface of the workpiece (strip).

It is advisable to dispose the slit type jet flow nozzles around a vertical axis to the surface of the plate workpiece so that the distance between two colliding lines formed by the jetted flows, facing to each other, enlarges as it approaches the side of the plate workpiece. In this case it is advisable that the angle formed by the two colliding lines formed by the slit type jetted flows colliding with the workpiece is 3° to 30°. By so setting the angle formed by the colliding lines of the two jetted flows, both the jetted fluid and the scales can be removed from the strip surface in the transverse direction by the widthwise velocity component of the jetted flows.

Moreover, in the descaling apparatus according to the present invention, it is also effective to additionally provide a means for effecting a transverse gas flow flowing in the transverse direction of the rolling line direction along the colliding surface of the jetted flow of the workpiece. It is preferable to set the distance between the colliding points where the opposing jetted flows collide with the surface of the workpiece approximately the spray colliding width plus 10 mm. By having a transverse gas flow by use of a blower, etc. in the transverse direction (widthwise direction of the plate workpiece) along the colliding surface of the jetted flow of the workpiece, both the jetted fluid and the scales can be removed from the strip surface in the transverse direction.

Incidentally, as for descaling the lower side of the strip, there is no need for such a means for effecting a transverse flow of the scales.

Water can be used for the jetted fluid in the descaling apparatus to be used for a hot rolling mill according to the present invention.

Further, if the first jet flow nozzle, disposed to face downstream, is disposed vertically to the surface of the metal workpiece to be rolled, descaling can still be done efficiently. That is, if a high pressure jetted fluid is jetted to collide with the metal plate workpiece in the vertical direction from the first jet flow nozzle, scales are cooled by the jetted flow, and cracks are generated in the scales on the surface of the metal plate workpiece. Then, upon a high pressure jetted fluid being jetted at an incline from the second jet flow nozzle to collide with the surface of the metal plate workpiece on the downstream side, the scales are flaked and fractured by the colliding pressure of the jetted fluid as well as by the action of vaporization and expansion of the fluid entering the gaps of cracks. The scales are thus blown off and removed along the surface of the metal plate workpiece.

Further, it is preferable to construct any one or both of the first and the second jet flow nozzles in the descaling apparatus to be used for the hot rolling mill according to the present invention so that the inclined angle is changeable. By so constructing the jet flow nozzle, if the inclined angle of the jet flow nozzle is set close to the vertical state, for example, the colliding angle of the high pressure jetted fluid becomes smaller, so that the colliding area decreases and the amount of lowering of the temperature becomes less. Thus the lowering of the surface temperature of the metal plate workpiece becomes smaller. Reversely, by the inclined angle of the jet flow nozzle being set more inclinedly, the colliding angle of the high pressure jetted fluid becomes larger so that the colliding area increases. The amount of lowering of the temperature thus becomes greater, and the lowering of the surface temperature of the metal plate workpiece is accelerated.

Incidentally, as for the adjustment of the inclined angle of the jet flow nozzle, it is preferable that the surface temperature of the metal plate workpiece to be rolled is detected by a temperature detecting means. Based on the detected information, the adjustment is made by an inclination control means.

By the inclined angle of the jet flow nozzle being set in a range of 15° to 75°, the removing capability of scales is maintained, and yet the amount of lowering of the surface temperature of the metal plate workpiece can be adjusted freely.

Further, the first and the second jet flow nozzles in the descaling apparatus to be used for the hot rolling mill according to the present invention can be constructed by a group of a plurality of tube-like nozzles arrayed in the widthwise direction of the metal workpiece.

Moreover, in order to attain the above-mentioned object, the present invention provides a hot rolling mill comprising, successively, a thin slab center for casting a slab continuously from molten metal, a descaling apparatus having a plurality of jet flow nozzles for jetting a high pressure fluid to the surface of the slab to remove scales of the slab surface, a reduction mill for rough rolling of the slab, a pendulum shear for shearing the rough rolled strip to a predetermined length, a heating furnace for heating the strip to a temperature higher than the temperature at which finish rolling becomes possible, a plurality of down coilers to coil the strip, a descaling apparatus having a plurality of jet flow nozzles for jetting a high pressure fluid to the surface of the strip uncoiled from the down coilers to remove scales of the strip surface, and a finishing mill line for finish rolling of the strip.

In this case, it is preferable that at least one of the two descaling apparatuses is constructed by a descaling apparatus having first and second jet flow nozzles disposed to incline and face in the downstream and upstream directions, so that two jet flows jetted to the slab (or strip) surface collide with each other.

If a slab having scales is rolled, the scales bite into the slab so that the product is negatively affected. So, according to the continuous casting apparatus having the construction of the present invention, scales are removed and a cleanly rolled product can be obtained.

By the rolling machines being successively arranged, there are obtained the advantages of shortening of the line length, enhancing the line efficiency and lowering the amount of heating at the time of reheating to a temperature at which rolling becomes possible.

Further, by the nozzles being disposed so that two jetted flows directed to the slab surface collide with each other, the colliding area of the jetted flows is enlarged so that the descaling area is enlarged, and thereby the descaling ability is enhanced.

As scales tend to be generated during hot rolling, a descaling apparatus is installed at this point, especially. The front of a hot rolling mill is most important, as there is a large amount of scales at this point because of reheating.

BRIEF DESCRIPTION OF THE DRAWINGS

In the accompanying drawings:

FIG. 2(b) is a side view and FIG. 2(*c*) is an explanatory view of the operation;

DESCRIPTION OF THE PREFERRED EMBODIMENTS

Herebelow, description is made of preferred embodiments according to the present invention with reference to the figures.

Figure 1A:
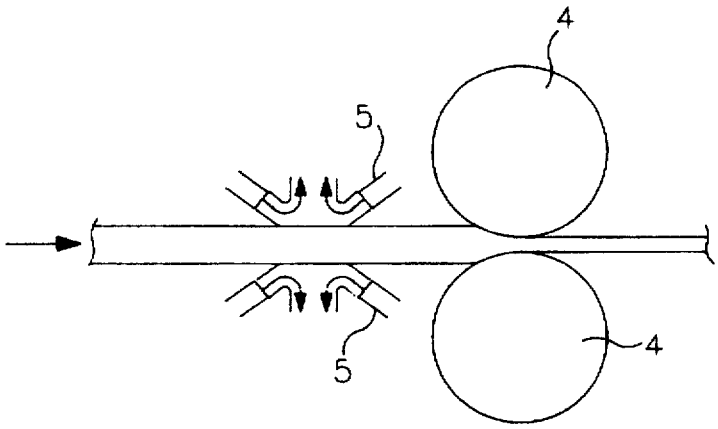
FIGS. 1A–1B are schematic views of an opposite jet flow type descaling apparatus used for a hot rolling mill of one preferred embodiment according to the present invention, wherein FIG. 1(*a*) is a view showing a descaling apparatus disposed on the upstream side of a pair of hot rolling rolls and FIG. 1(*b*) is a view showing a descaling apparatus disposed on the upstream side of each of a plurality of pairs of hot rolling rolls.
Figure 1B:
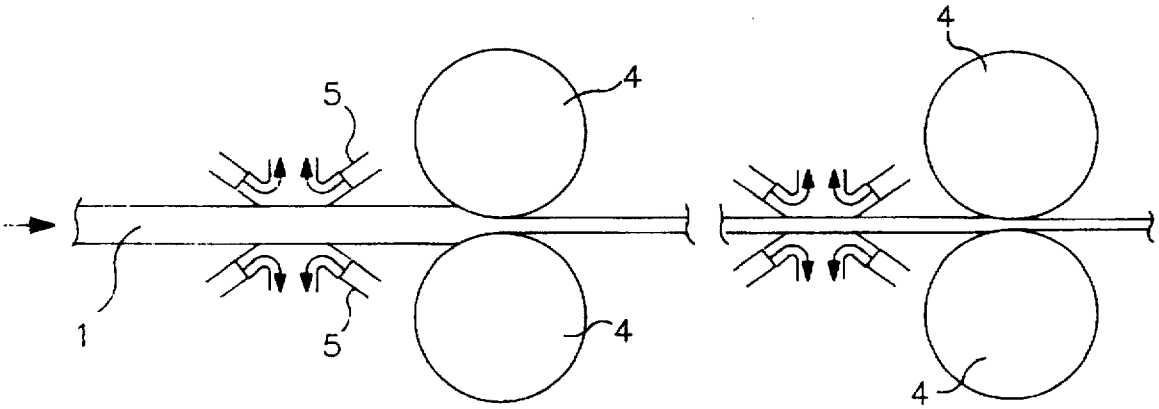

In FIG. 1, numeral 1 designates a workpiece to be rolled or a strip, numeral 4 designates a rolling roll and numeral 5 designates a descaling apparatus. The strip 1 is transferred in the direction shown by an arrow so as to be rolled by the hot rolling mill.

If descaling is carried out at rolling conditions where, for example, the thickness of the workpiece to be rolled is 30 mm$^t$, the rolling velocity is 8m/min, the flow rate of jetted fluid (water) on both the upper and lower surfaces of the strip is 800 l/min (per 1 m width) and the jetting pressure is 150 kgf/cm$^2$, the lowering of the temperature of the strip between the mill inlet side and the mill outlet side can be reduced to as little as 5° C. according to the present invention. The amount of lowering is 30° C. for the conventional plate thickness average. This is obtained by the present invention by having opposed jetted flows with a distance between the colliding points of the opposed jetted flows on the surface of the workpiece set to 50 mm.

Figure 2A:
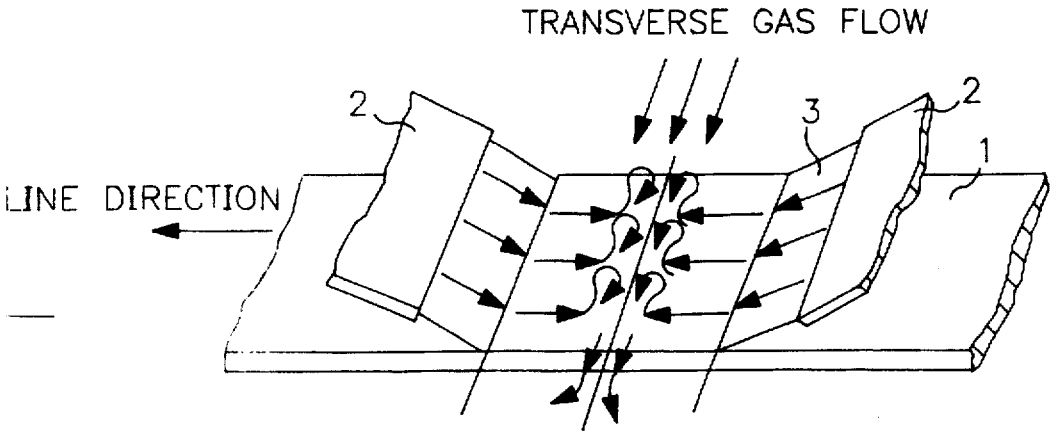
FIGS. 2A–2C are detailed views of an opposite jet flow type descaling apparatus used for a hot rolling mill according to the present invention, wherein FIG. 2(*a*) is a perspective view showing a state of operation.
Figure 2B:
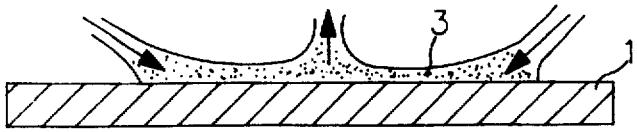
Figure 2C:
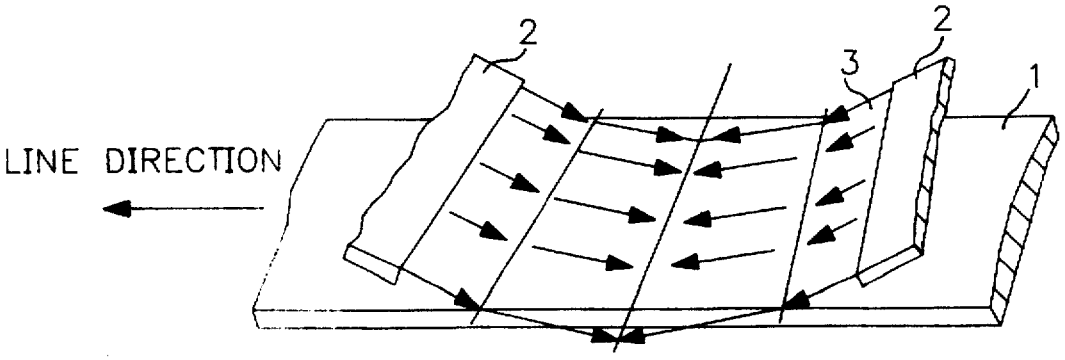

Referring to FIGS. 2A–2C, slit type jet flow nozzles 2 are disposed so as to incline in a direction so as to face each other. The range of the angle of inclination is 15° to 60° with respect to the horizontal direction of the strip surface. Jetted flows 3 of fluid, being liquid, gas or plasma, thus collide with the strip surface and then collide with each other. With these slit type jet flow nozzles 2 being arrayed with a predetermined space between them, the descaling apparatus 5 is formed.

Further, a means (a blower, etc., for example) for effecting a transverse gas flow in a direction crossing the rolling line, in a right angle along the jetted flow colliding surface of the strip 1, is provided. The jetted flows 3 and the scales on the strip surface can then be taken away from the strip surface in a transverse direction.

Figure 3A:
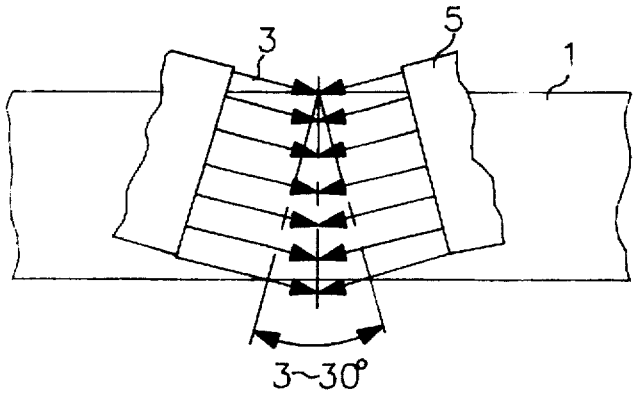
FIGS. 3A–3C are views showing an arrangement of jet flow nozzles in a descaling apparatus used for a hot rolling mill according to the present invention, wherein FIG. 3(*a*) is a plan view, FIG. 3(*b*) is a side view and FIG. 3(*c*) is an explanatory view of a spray colliding width.
Figure 3B:
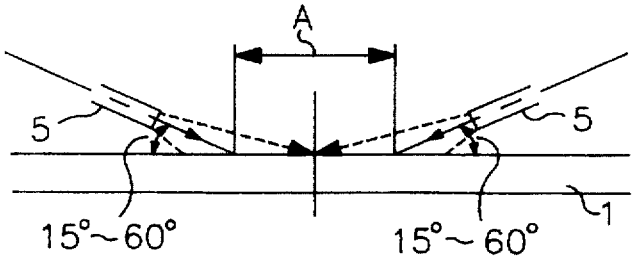
Figure 3C:
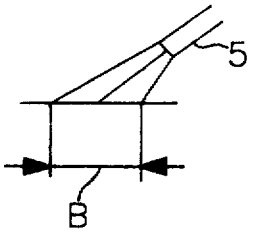

FIGS. 3 show one arrangement of jet flow nozzles in the descaling apparatus 5. The jet flow nozzles of the descaling apparatus 5 are disposed so as to incline and face each other, having a large of the angle of inclination of 15° to 60° with respect to the horizontal direction of the strip 1. Further, an angle formed by two colliding lines formed by the jetted flows 3 colliding with the strip is in a range of 3° to 30°.

With the above construction, both the jetted fluid and the scales can be removed from the strip surface in the inclined transverse direction by the widthwise velocity component of the jetted flows 3.

Incidentally, in FIG. 3, letter A designates a jetted flow colliding width and letter B designates a spray colliding width. The jetted flow colliding width A is set to approximately the spray colliding width B plus 10 mm. If this colliding width A is smaller, the cooling of the plate workpiece to be rolled is memorized. But in the present invention, in order to prevent the sprays from directly colliding with each other, the width A is set to approximately the spray colliding B width plus 10 mm.

Figure 4A:
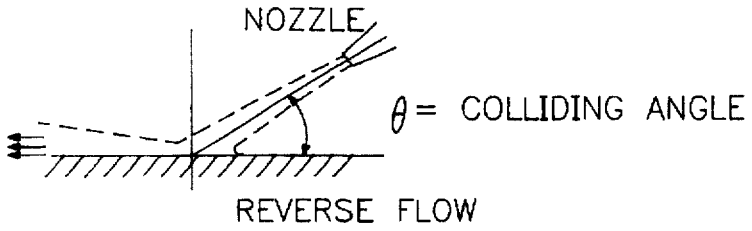
FIGS. 4A–4B are an illustration of and an explanatory graph with respect to the angle of jet flow nozzles in a descaling apparatus used for a hot rolling mill according to the present invention.
Figure 4B:
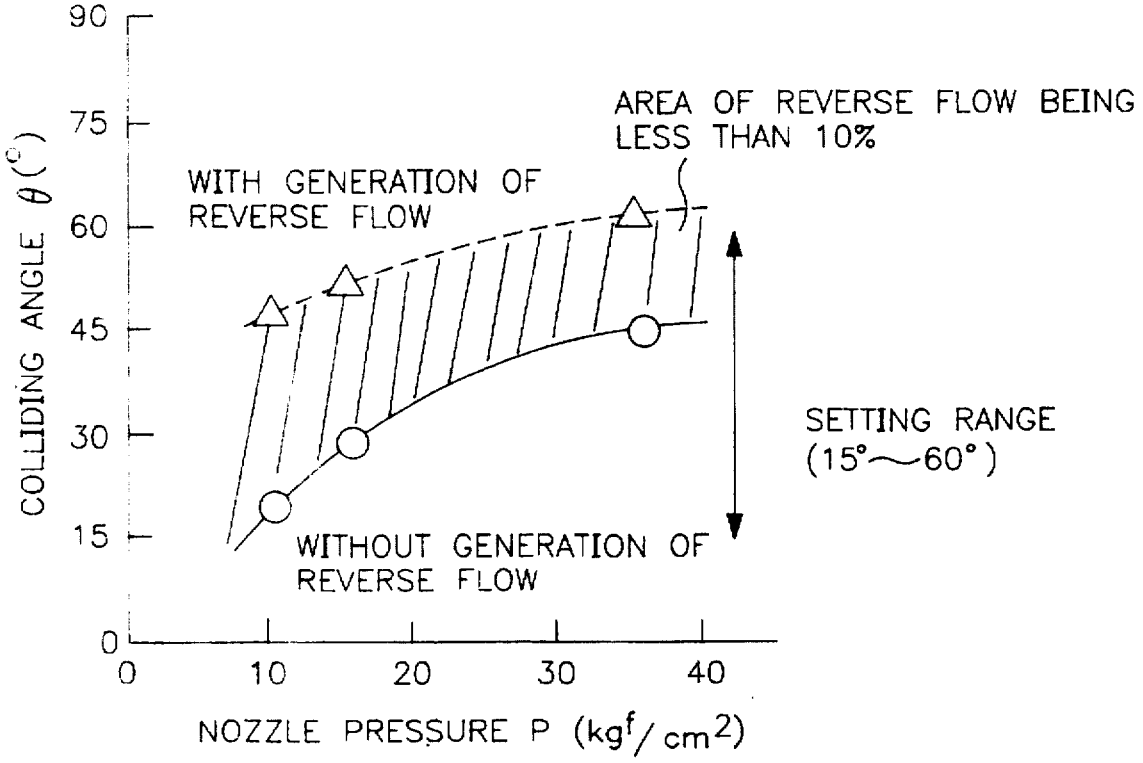

FIGS. 4A and 4B show the relation, with respect to the generation of a reverse flow, between a jet flow nozzle pressure and a colliding angle. If the colliding angle θ is set in the range of 15° to 60° as shown in the figure, a reverse flow, generated in a direction reverse to the jetted workpiece, can be made less than 10%. Thus the length of the cooling area can be prevented from becoming longer than needed due to the reverse flow.

Further, if the jetted flow direction is inclined at a certain angle to the line direction, a flow velocity component in a direction traverse to the line direction is generated. The descaled scales can then flow off in the widthwise direction of the strip from the surface of the workpiece to be rolled.

If the inclined angle is less than 2° for a workpiece to be rolled having a width more than 1 m, the ability to let scales flow off will be insufficient. If it is more than 30°, the difference between the colliding distances (the distances between the colliding points of the jetted flows) at the widthwise end portion of the strip and at the widthwise central portion of the strip becomes too large, in that the difference of the amount of cooling in the widthwise direction becomes a problem.

Figure 5:
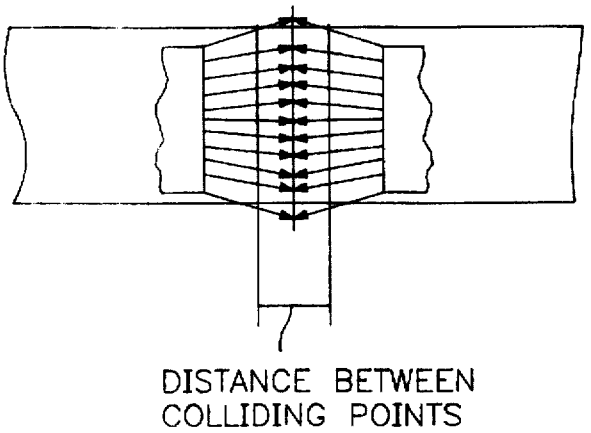
FIG. 5 is a plan view of another preferred embodiment of the arrangement of jet flow nozzles in a descaling apparatus used for a hot rolling mill according to the present invention.

In this case, a nozzle arrangement as shown in FIG. 5 is preferably employed, in which each nozzle direction is changed and adjusted so that the colliding distance becomes constant.

Next, a preferred embodiment according to the present invention in which a descaling apparatus is provided for a thin slab (strip) made by a dual belt type continuous casting apparatus is described with reference to FIG. 6.

Figure 6:
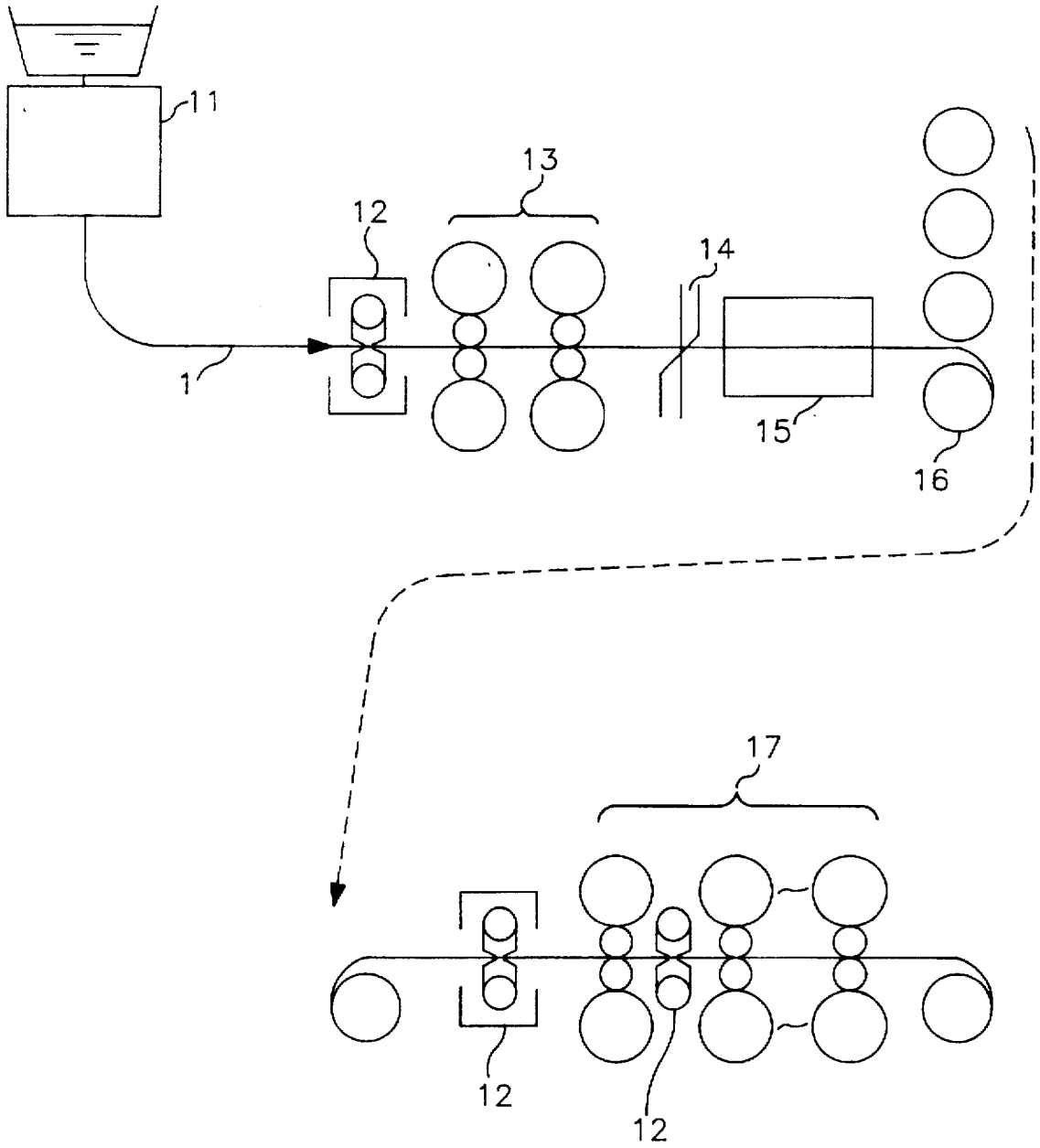
FIG. 6 is a schematic view showing a construction of a dual belt type continuous casting apparatus as one preferred embodiment according to the present invention.

In FIG. 6, numeral 11 designates a thin slab caster of a dual belt type continuous casting operation. Numeral 12 designates a reduction mill (roughing mill), numeral 14 designates a pendulum shear, numeral 15 designates a heating furnace, numeral 16 designates a down coiler to coil the this slab and numeral 17 designates a finishing mill.

Figure 7:
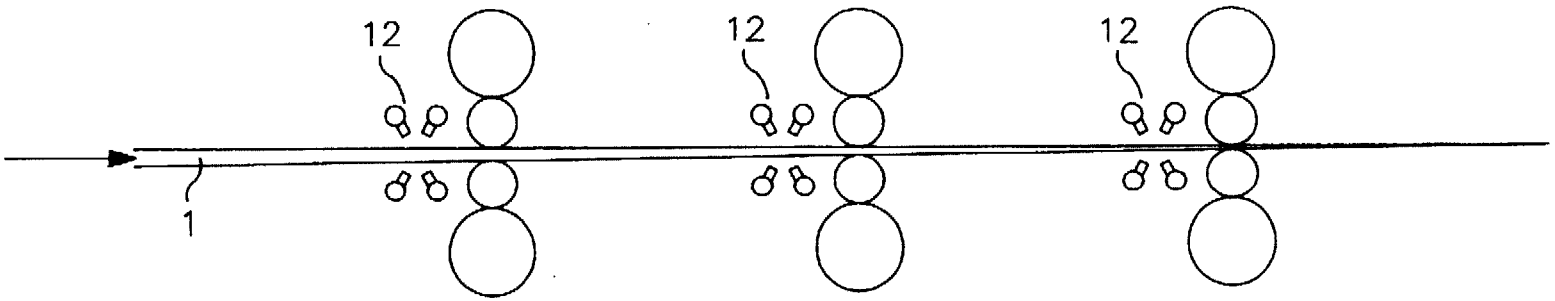
FIG. 7 is a schematic view showing a construction of a descaling apparatus of FIG. 6.

In the duel belt type continuous casting apparatus shown in FIG. 6, molten metal is cast into a slab by the thin slab caster 11. The thin slab coming out therefrom, before it enters the roughing mill 13, is descaled by the descaling apparatus 12. Thereafter, the thin slab is transferred to the finishing mill 17 through the descaling apparatuses 12 to be finish rolled and coiled. An example of an arrangement of the descaling apparatuses 12 is shown in FIG. 7.

The thin slab, after being rough rolled, is once coiled by the down coiler 16 for the reason that there is a large difference in the slab transfer velocities during continuous casting and during finish rolling.

The heating furnace 15 is provided for heating the strip, before it is coiled, to a temperature at which finish rolling becomes possible.

Incidentally, the descaling apparatus 12 employed in this preferred embodiment is of the same structure as that described in the previous preferred embodiments, and detailed description thereof is omitted.

If a slab obtained by continuous casting and having scales is rolled, the scales bite into the slab and the product is negatively affected. A descaling apparatus thus becomes necessary. Due to the rolling machines being successively arranged, there are obtained the advantages of shortening the line length, enhancing the line efficiency and lowering the amount of heating during the reheating to a temperature at which rolling becomes possible.

Further, by the nozzles being disposed so that the two jetted flows directed toward the slab surface collide with each other, the colliding area of the jetted flows is enlarged so that the descaling area is enlarged. The descaling ability is thereby enhanced.

As scales tend to be generated during hot rolling, a descaling apparatus is installed at this point. The front of the hot rolling mill is most important because of a large amount of scales at this point because of reheating.

Next, an example of a concrete structure of the descaling apparatus used in the above-mentioned preferred embodiments is described with reference to FIG. 8.

Figure 8:
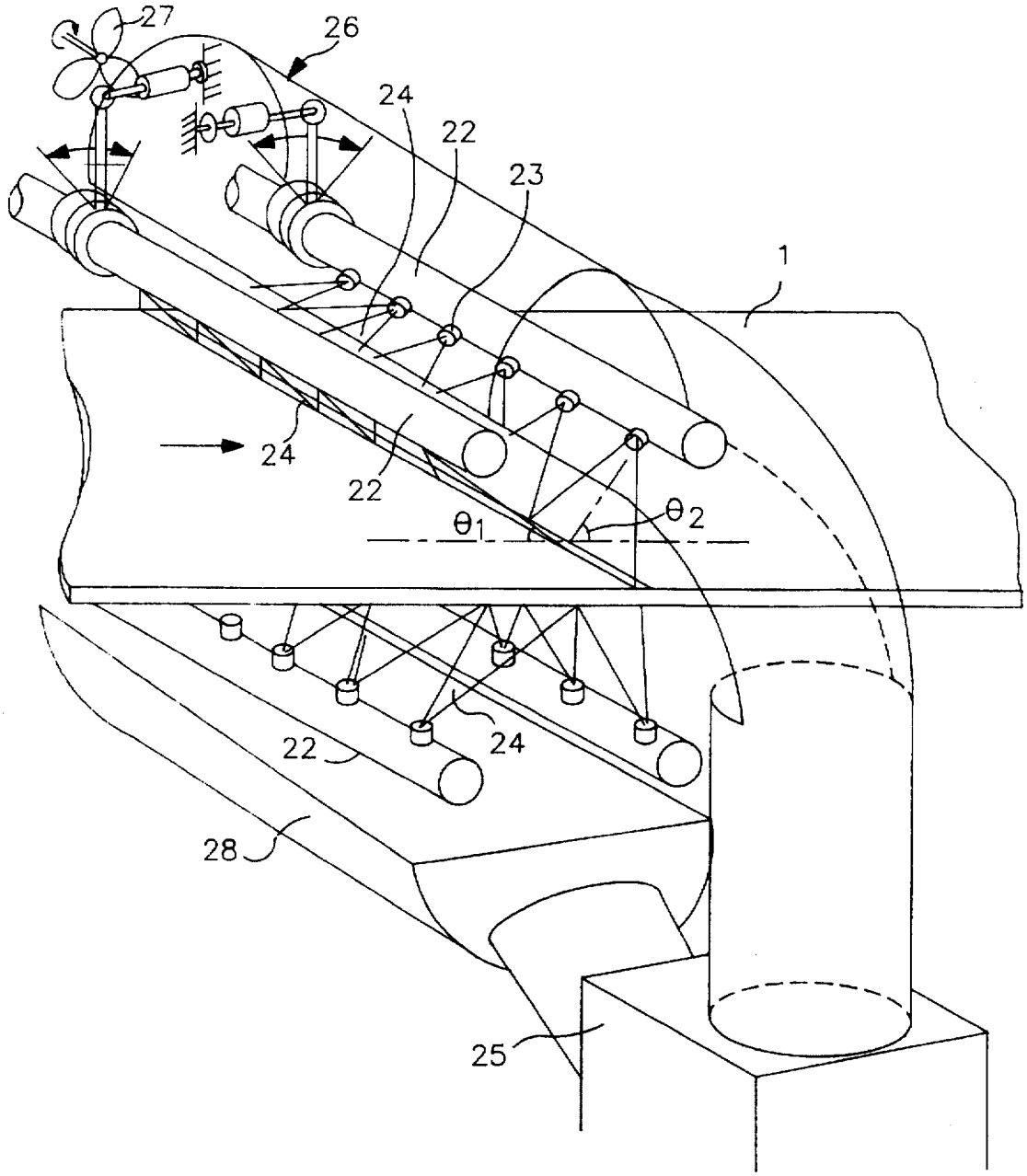
FIG. 8 is a perspective view showing a construction of a descaling apparatus of FIG. 6.

As shown in FIG. 8, a pair of headers 22 having nozzle tips 23 disposed thereon at equal spaces for jetting descaling fluid to a workpiece 1 to be hot rolled are disposed on the upper side and on the lower side, respectively, of the workpiece 1. The header 22 is rotatable around it axis by an angle of +/−30°, and the colliding angle of jetted flows 24 from the header 22 can thereby be changed in a range of 30° to 90° to the surface of the workpiece to be rolled. As a standard operational condition, the colliding angle of the jetted flows of both the front and the rear headers in the line direction is set to 45°, and the colliding distance (the distance between the colliding points) is set to 20 mm.

According to this descaling apparatus, when compared with a conventional descaling apparatus having one header on each of the upper side and the lower side of the workpiece to be rolled, the thickness of scale residuals, after descaling is made, is reduced from 5.5 μm in the conventional apparatus to 3.8 μm in the apparatus of the present invention (where the amount of fluid, being water, is 1400 λ/min and the header pressure is 210 kgf/cm$^2$ for both apparatuses).

Further, as the water, after collision, leaps up and down on the workpiece 1, a duct 26 is disposed above the upper headers 22 so that the water, together with the descaled scales, is blown toward one side end of the workpiece 1 by a blower 27 so as to be recovered. A recovery conduit 28 is disposed under the lower headers 22 for recovery of the water together with the descaled scales. Thus there are no cases seen of the descaled scales being bitten in the downstream rolling machines and the rolled workpiece becoming damaged.

Moreover, as the water, the jetted fluid, does not scatter on the upstream side and on the downstream side of the workpiece 1 to be rolled, a temperature sensor or a plate thickness meter of the workpiece 1, a roll profile meter, etc., become usable all the time. By the distance between the colliding points being changed by rotating the header 22, the plate thickness average temperature of an ordinary steel of 30 $mm^4$×60 m/min becomes adjustable in a range of 5° C. to 10° C.

Incidentally, the jetted fluid and the descaled scales collected by the duct 26 and the recovery conduit 28 are transferred to a recovery port 25.

Figure 9:
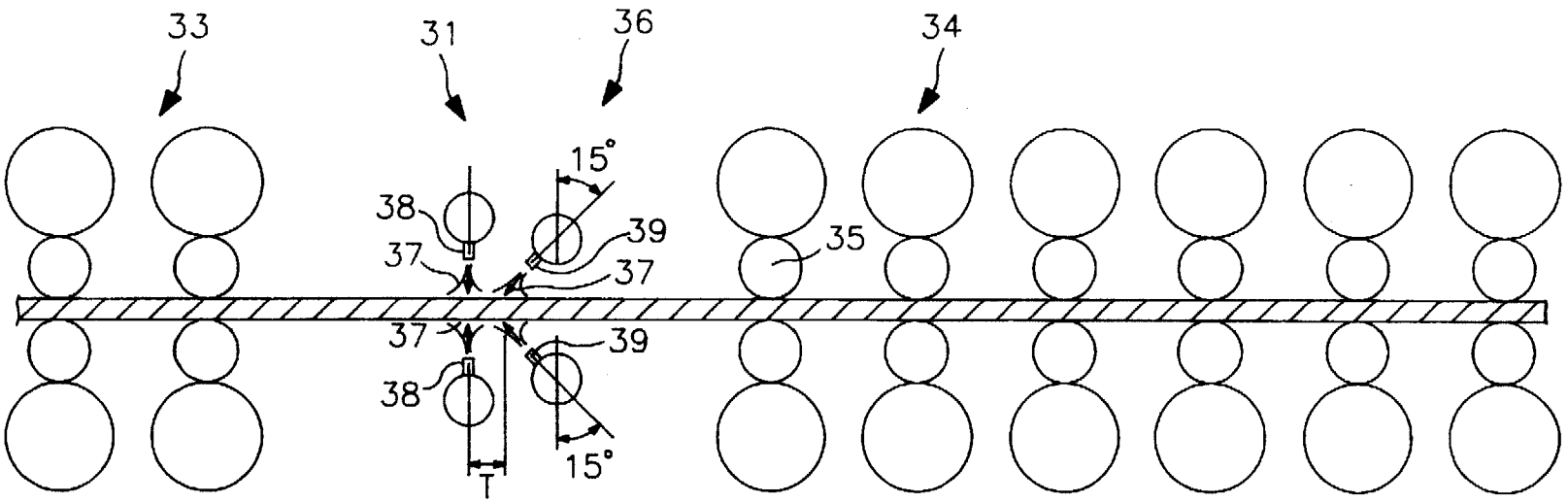
FIG. 9 is a schematic view of a hot rolling mill of still another preferred embodiment according to the present invention.
Figures 10A, 10B, 10C:
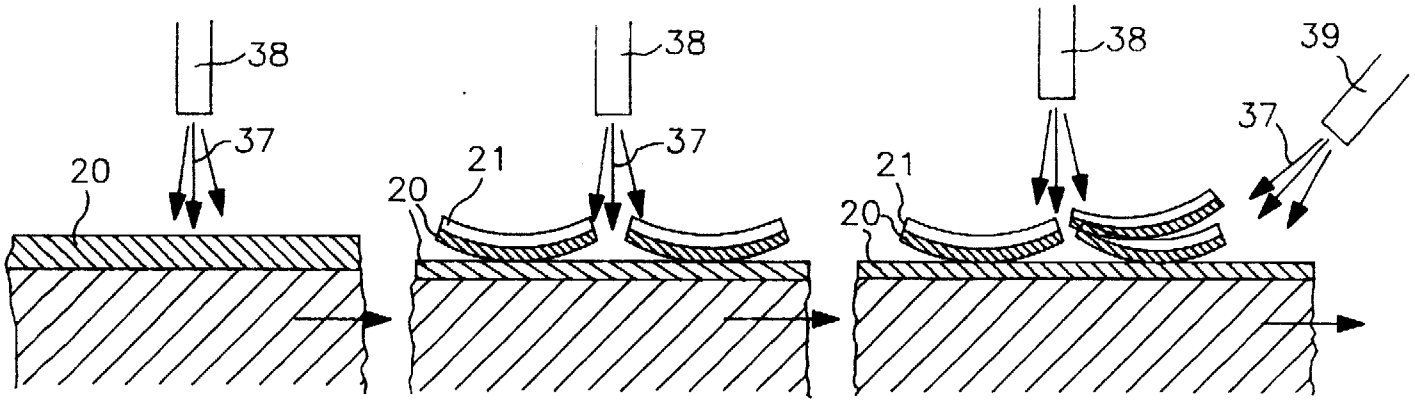
FIGS. 10A–10C are partially enlarged views showing a descaling state by use of jet flow nozzles of a descaling apparatus used for the hot rolling mill of FIG. 9.
Figure 11:
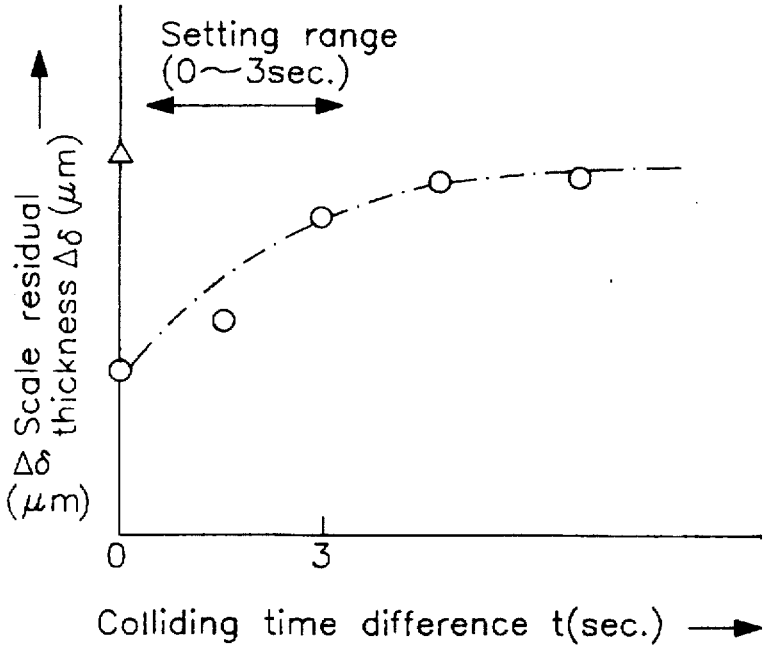
FIG. 11 is a graph showing the relation between scale residual thickness and colliding time differences of a high pressure jetted fluid.
Figure 12A:
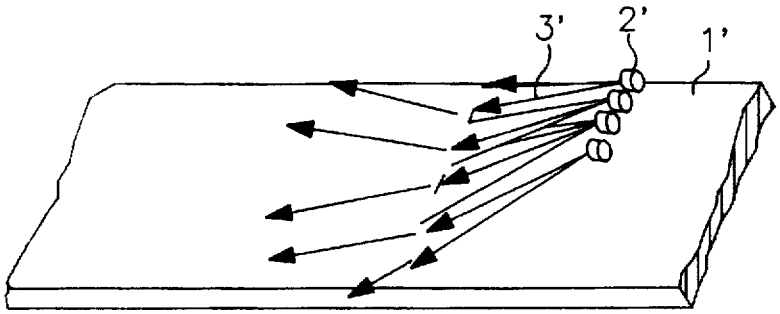
FIG. 12A PRIOR ART
FIGS. 12A–12B are schematic views of a descaling apparatus in the prior art, wherein FIG. 12(*a*) is a perspective view and FIG. 12(*b*) is a side view.
Figure 12B:
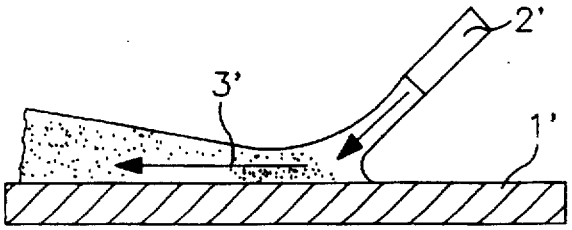
FIG. 12B PRIOR ART

Next, preferred embodiments shown in FIGS. 9 to 11 are described.

As shown in FIG. 9, in a hot rolling line 31, a metal plate workpiece (strip) 1 to be rolled is rough rolled by a rough rolling machine group 33 is then finish rolled by a finish rolling machine group 34. A pair of rolling rolls 35 of the finish rolling machine group 34 form at least one of the pairs of rolling rolls disposed opposingly on the upper side and on the lower side, with the strip 1 being pinched in between. Between the rough rolling machine group 33 and the finish rolling machine group 34, on the upstream side of the finish rolling machine group 34, a descaling apparatus 36 is disposed for descaling the surface of the strip 1 and for appropriately maintaining the hot rolling temperature.

In the descaling apparatus 36, a first jet flow nozzle 38 for jetting a high pressure jetted fluid 37 (water or $N_2$ gas, for example) in the vertical direction to the surface of the strip 1 to collide with the surface of the strip 1 is disposed on the upper side and on the lower side, respectively, of the strip 1. On the downstream side of the first jet flow nozzle 38 is disposed a second jet flow nozzle 39 for jetting a high pressure jetted fluid 37 in a direction inclined toward the upstream side of the line direction so as to collide with the surface of the strip 1. The second jet flow nozzle 39 is disposed on the upper side and on the lower side, respectively, of the strip 1.

The space between the first jet flow nozzle 38 and the second jet flow nozzle 39 is set so that the time until the two flows of the high pressure jetted fluid 37 mutually collide over the colliding distance (the distance between the colliding points on the strip 1) falls within a predetermined time difference (3 seconds, for example). The second jet flow nozzle 39 is inclined with an angle of approximately 15° in the upstream direction from the vertical line to the surface of the strip 1. This is for the reason that, if the inclined angle is made smaller than 15° so as to approach to the vertical line, the high pressure jetted fluid 37 flows in a direction toward the downstream rolling rolls 35, and there is a fear that the descaled scales may be bitten between the rolling rolls 35.

In case descaling is carried out by use of above-mentioned descaling apparatus 36, the high pressure jetted fluid 37 is jetted from the first jet flow nozzle 38 in the vertical direction so as to collide with the surface of the strip 1. The scales on the strip surface are thereby cooled so that cracks are generated. The high pressure jetted fluid 37 is then jetted from the second jet flow nozzle 39 in the direction inclined with an angle of approximately 150 toward the upstream side of the strip 1 so as to collide with the strip surface. The scales are thereby flaked and fractured by the colliding pressure of the jetted fluid as well as by the action of vaporization and expansion of the fluid that enters the cracks. The fractured scales are blown off along the strip surface, and thus the descaling is carried out.

The above-mentioned action is described in FIG. 10. FIG. 10 shows a descaling state of scales on the surface of the strip 1. Numeral 20 designates a scale consisting of an iron oxide FeO and numeral 21 designates a scale consisting of components of $Fe_2O_3$ and $Fe_3O_4$.

As shown in FIG. 10(*a*), the high pressure jetted fluid 37 is jetted from the first jet flow nozzle 38 to collide with the surface of the strip 1. Then as shown in FIG. 10(*b*), fine cracks are generated on the surface of scales so that the scales become warped. Next, as shown in FIG. 10(*c*), the high pressure jetted fluid 37 is jetted from the second jet flow nozzle 39 disposed downstream of the first jet flow nozzle 38 to collide with the strip surface. Thus the scales are flaked and fractured, and are blown off to be removed.

FIG. 11 shows the relation between the scale residual thickness Δδ (μm) and the colliding time difference t (sec) when the high pressure jetted fluid 37 is jetted from the first jet flow nozzle 38 and the second jet flow nozzle 39 to collide with the strip surface. As shown in the figure, if the colliding time difference t is within 3 seconds, the scale residual thickness Δδ decreases sharply, and if the colliding time difference t exceeds 3 seconds, the scale residual thickness becomes less changeable. For this reason, if the set range of the colliding time difference t is 0 to 3 seconds, the scale residual thickness Δδ becomes less than that of the conventional descaling apparatus (as marked with Δ). Incidentally, in case the colliding time difference t is 0 seconds, the scale residual thickness is appropriately half of that of the conventional descaling apparatus (as marked with Δ) and the descaling ability is approximately doubled.

In the above-mentioned descaling apparatus, as the high pressure jetted fluid 37 is jetted in two stages, from the first jet flow nozzle 38 and the second jet flow nozzle 39, the scales are flaked and fractured by the colliding pressure of the jetted fluid as well as by the action of vaporization and expansion of the fluid entering the cracks, and are blown off to be removed. For this reason, the descaling apparatus according to the present invention can also be applied to a strip of a low descalable material (Si containing high tension steel, etc.) with the appropriate pressure and flow rate of the high pressure jetted fluid 37.

Further, as there is a time difference in the collisions of the high pressure jetted fluid 37 jetted from the first jet flow nozzle 38 and the second jet flow nozzle 39, the action of crack generation and the action of descaling are separated, and the pressure and the flow rate of the high pressure jetted fluid 37 most appropriate for the respective action can be applied. Thus, the abrasion of the jet flow nozzle decreases so that the life thereof is elongated, and the lowering of the strip temperature can be reduced.

While various preferred embodiments according to the present invention are described above, the present invention is not limited to the preferred embodiments. Various changes and modifications within the range of technological concept of the present invention are possible without departing from the spirit and scope of the appended claims.

As described above, according to a descaling apparatus used for a hot rolling mill of the present invention, as the flows opposingly jetted from nozzles stay only for a short time on the surface of the workpiece to be rolled during the descaling of the surface, a lowering of the strip temperature can be reduced and a deterioration of the quality of the hot rolled workpiece can be prevented.

Further, a transverse gas flow is effected in the transverse direction to the rolling line direction (widthwise direction of the plate workpiece). The jetted fluid and the scales can thereby be taken away in the transverse direction of the strip surface.

What is claimed is:

1. A hot rolling mill comprising:

a hot rolling machine line for rolling a workpiece, said hot rolling machine line having an upstream end and a downstream end, a workpiece travel direction and a workpiece travel area along which is disposed a surface of a workpiece when the workpiece travels in the workpiece travel direction; and a descaling apparatus disposed immediately upstream of said hot rolling machine line, said descaling apparatus comprising first jet flow nozzles disposed so as to face downstream and so as to be inclined relative to the workpiece travel direction, and second jet flow nozzles disposed so as to face upstream and so as to be inclined relative to the workpiece travel direction, said first and second jet flow nozzles being arranged such that lines extending from said first and second jet flow nozzles in the directions in which said first and second jet flow nozzles face first intersect said workpiece travel area before intersecting each other as seen in a direction perpendicular to the travel direction and parallel to the workpiece travel area, such that when fluid is jetted from each of said first and second jet flow nozzles, and a workpiece moves past said descaling apparatus to said hot rolling machine line, the jetted flows of fluid first collide with a surface of the workpiece and then collide with each other.

2. The hot rolling mill of claim 1, wherein said first and second jet flow nozzles face each other and are inclined at an angle of 15 to 60 degrees with respect to the direction of travel of the workpiece.

3. The hot rolling mill of claim 1, wherein said first and second jet flow nozzles face each other and are disposed relative to a horizontal plane extending in the workpiece travel direction such that the jetted flows of fluid from said first and second jet flow nozzles form colliding lines that intersect with the horizontal plane and diverge with respect to each other in said horizontal plane in directions lateral to the workpiece travel direction.

4. The hot rolling mill of claim 1, wherein said first and second jet flow nozzles face each other and form means for jetting fluid flows onto a surface of a workpiece such that diverging lines of collision of the fluid flows on the surface of the workpiece are formed, the lines diverging in a direction lateral to the workpiece travel direction.

5. The hot rolling mill of claim 1, and further comprising a means for causing a flow of gas in a direction perpendicular to the workpiece travel direction and along a surface of a workpiece being descaled by said descaling apparatus.

6. The hot rolling mill of claim 1, wherein said first and second jet flow nozzles are disposed relative to the workpiece travel area such that the jetted flows of fluid from said first and second jet flow nozzles form colliding lines with the workpiece travel area that are spaced apart a distance approximately equal to the width of a spray colliding area of one of the jetted flows of fluid plus 10 mm.

7. The hot rolling mill of claim 1, wherein said descaling apparatus comprises a supply of water connected with said first and second jet flow nozzles.

8. The hot rolling mill of claim 1, wherein said first jet flow nozzle is disposed at an angle of inclination equal to about 90 degrees relative to the workpiece travel direction.

9. The hot rolling mill of claim 1, wherein at least one of said first and second jet flow nozzles is movably mounted such that an angle of inclination with respect to the workpiece travel direction can be changed.

10. The hot rolling mill of claim 1, wherein at least one of said first and second jet flow nozzles comprises a tube extending laterally of the workpiece travel direction and a plurality of spray openings in said tube.

11. The hot rolling mill of claim 2, wherein said first and second jet flow nozzles are inclined at an angle of 15 to 60 degrees with respect to a horizontal plane containing a line extending in the workpiece travel direction.

12. The hot rolling mill of claim 3, wherein the colliding lines diverge at an angle of 3 to 30 degrees.

13. A hot rolling mill comprising:

a hot rolling machine line for rolling a workpiece, said hot rolling machine line comprising rolling machines and having an upstream end and a downstream end, a workpiece travel direction and a workpiece travel area along which a is disposed a surface of a workpiece when the workpiece travels in the workpiece travel direction; and a descaling apparatus disposed between said rolling machines of said hot rolling machine line, said descaling apparatus comprising first jet flow nozzles disposed so as to face downstream and so as to be inclined relative to the workpiece travel direction, and second jet flow nozzles disposed so as to face upstream and so as to be inclined relative to the workpiece travel direction, said first and second jet flow nozzles being arranged such that lines extending from said first and second jet flow nozzles in the directions in which said first and second jet flow nozzles face first intersect said workpiece travel area before intersecting each other as seen in a direction perpendicular to the travel direction and parallel to the workpiece travel area, such that when fluid is jetted from each of said first and second jet flow nozzles and a workpiece moves past said descaling apparatus to said hot rolling machine line, the jetted flows of fluid first collide with a surface of the workpiece and then collide with each other.

14. The hot rolling mill of claim 13, wherein said rolling machines comprise first and second rolling machines from the upstream end of said hot rolling machine line and said descaling apparatus is disposed between said first and second rolling machines.

15. The hot rolling mill of claim 13, and further comprising a second descaling apparatus disposed immediately upstream of said hot rolling machine line, said descaling apparatus comprising third jet flow nozzles disposed so as to face downstream and so as to be inclined relative to the workpiece travel direction, and fourth jet flow nozzles disposed so as to face upstream and so as to be inclined relative to the workpiece travel direction, said third and fourth jet flow nozzles being arranged such that when fluid is jetted from each of said third and fourth jet flow nozzles and a workpiece moves past said descaling apparatus to said hot rolling machine line, the jetted flows of fluid first collide with a surface of the workpiece and then collide with each other.

16. The hot rolling mill of claim 14, and further comprising a second descaling apparatus disposed immediately upstream of said hot rolling machine line, said descaling apparatus comprising third jet flow nozzles disposed so as to face downstream and so as to be inclined relative to the workpiece travel direction, and fourth jet flow nozzles disposed so as to face upstream and so as to be inclined relative to the workpiece travel direction, said third and fourth jet flow nozzles being arranged such that when fluid is jetted from each of said third and fourth jet flow nozzles and a workpiece moves past said descaling apparatus to said hot rolling machine line, the jetted flows of fluid first collide with a surface of the workpiece and then collide with each other.

17. A hot rolling mill comprising:

a continuous thin slab caster for casting a thin slab from molten metal;

a first descaling apparatus comprising a plurality of jet flow nozzles connected to a source of high pressure fluid for jetting the high pressure fluid against the surface of the thin slab to remove scales from the surface of the thin slab;

a reduction mill for rough rolling of the thin slab;

a pendulum shear for shearing a strip of predetermined length from the thin slab;

a heating furnace for heating the strip to a temperature higher than a temperature necessary for finish rolling;

a plurality of down coilers for coiling the strip;

a second descaling apparatus comprising a plurality of jet flow nozzles connected to a source of high pressure fluid for jetting the high pressure fluid against the surface of the strip when the strip is uncoiled from said down coilers to remove scales from the surface of the strip, the second descaling apparatus having a strip travel direction there through and a workpiece travel area along which is disposed a surface of a strip when the strip travels in the strip travel direction; and a finish mill line for finish rolling of the strip;

wherein said second descaling apparatus is disposed immediately upstream of said finish mill line, said second descaling apparatus comprising first jet flow nozzles disposed so as to face downstream and so as to be inclined relative to the strip travel direction, and second jet flow nozzles disposed so as to face upstream and so as to be inclined relative to the strip travel direction, said first and second jet flow nozzles being arranged such that lines extending from said first and second jet flow nozzles in the directions in which said first and second jet flow nozzles face first intersect said strip travel area before intersecting each other as seen in a direction perpendicular to the travel direction and parallel to the strip travel area, such that when fluid is jetted from each of said first and second jet flow nozzles and the strip moves past said second descaling apparatus to said hot rolling machine line, the jetted flows of fluid first collide with a surface of the strip and then collide with each other.

18. The hot rolling mill of claim 17, wherein said first descaling apparatus has a thin slab travel direction there through, said first descaling apparatus comprising first jet flow nozzles disposed so as to face downstream and so as to be inclined relative to the slab travel direction, and second jet flow nozzles disposed so as to face upstream and so as to be inclined relative to the slab travel direction, said first and second jet flow nozzles being arranged such that when fluid is jetted from each of said first and second jet flow nozzles and the slab moves past said second descaling apparatus toward said reduction mill, the jetted flows of fluid first collide with a surface of the workpiece and then collide with each other.

* * * * *